United States Patent [19]

Matsumoto et al.

[11] Patent Number: 4,615,145

[45] Date of Patent: Oct. 7, 1986

[54] APPARATUS FOR MECHANICALLY FINISHING WORKPIECES

[75] Inventors: Hiroshi Matsumoto, Hirakata; Man Fujiki, Niigata, both of Japan

[73] Assignee: C. Uyemura & Co., Ltd., Osaka, Japan

[21] Appl. No.: 671,216

[22] Filed: Nov. 14, 1984

[30] Foreign Application Priority Data

Nov. 30, 1983 [JP] Japan ..... 58-226411

[51] Int. Cl.[4] ..... B24B 31/00

[52] U.S. Cl. ..... 51/19; 51/419; 51/237 M

[58] Field of Search ..... 51/6, 7, 17, 19, 317, 51/237 M, 419

[56] References Cited

U.S. PATENT DOCUMENTS 2,899,777 8/1959 Davidson ..... 51/7
2,915,852 12/1959 Wabeke ..... 51/7
4,186,528 2/1980 Yascheritsyn et al. ..... 51/7 X
4,205,487 6/1980 Anderson et al. ..... 51/7
4,240,229 12/1980 Ohno ..... 51/19 X
4,280,302 7/1981 Ohno ..... 51/7

*Primary Examiner*—Robert P. Olszewski
*Attorney, Agent, or Firm*—Birch, Stewart, Kolasch & Birch

[57] ABSTRACT

A polishing apparatus is provided with a fixed gear and at least one planet gear which meshes with the fixed gear to make at least one spindle coupled to said planet gear perform orbital revolution and own rotation by making the planet gear rotate around its own axis while orbitally revolving said planet gear around the fixed gear, thus rotating the workpieces fitted to said spindle in the polishing bath to be subject to fluidized polishing with the media filled up in the polishing bath, wherein said spindle is formed as a cylinder in which a rotary shaft is arranged rotatably and a rotating mechanism for rotating the rotary shaft is provided to rotate the workpieces at the same time the rotation of said rotary shaft, thus permitting the workpieces to be uniformly polished.

10 Claims, 12 Drawing Figures

APPARATUS FOR MECHANICALLY FINISHING WORKPIECES

BACKGROUND OF THE INVENTION

The present invention relates to an apparatus for mechanically finishing workpieces such as spoons, ladles, pipes, cocks and other metallic parts for waterworks, gas cocks, watch cases, levers, brake arms, cranks for bicycles, etc. to provide them with uniformly polishing surfaces.

It has been known that a workpiece secured on a spindle may be moved to be polished at a high speed in dry media covered with abrasive grain particles and fatty substances in a polishing bath by making said spindle perform orbital revolution and on-the-axis rotation in forward and reverse directions (U.S. Pat. No. 2,899,777).

However, this conventional type of the polishing apparatus cannot, in some cases, uniformly polish the whole surfaces of workpieces. FIG. 1 shows workpiece "c" which is fixed on spindle "a" with jig "b". In the figure, spindle "a" revolves (orbitally) in the direction of arrowhead "R" or in a reverse direction to said arrowhead direction "R" and rotates (around its own axis) in direction "r" or in a reverse direction to said direction "r", thereby workpiece "c" is forced to revolve and rotate together with the orbital revolution and own rotation of the spindle "a". Since workpiece "c" is fixed on spindle "a", the relative position of workpiece "c" in reference to spindle "a" does not vary and therefore there may be a difference in the degree of polishing finish between the upper part and the lower part of workpiece "c" and between the internal surface and the external surface of workpiece "c" (an opposite surface to spindle "a" and a rear surface of said opposite surface to spindle "a").

SUMMARY OF THE INVENTION

An object of the present invention is to provide an apparatus for mechanically finishing workpieces capable of uniformly polishing all surfaces of workpieces by adapting the apparatus so that the relative positions of workpieces in reference to a spindle which revolves orbitally and rotates around its own axis makes the workpiece revolve and rotate together with the orbital revolution and rotation of the spindle.

More detailedly, the present invention provides a polishing apparatus which is provided with a fixed gear and at least one planet gear which meshes with said fixed gear to make at least one spindle coupled to said planet gear perform orbital revolution and rotation by causing said planet gear to perform orbital revolution and rotation around said fixed gear, thus rotating the workpieces fixed to said spindle to be polished in media in a polishing bath, characterized in that said spindle is formed as a cylinder in which a rotary shaft is disposed rotatably and a rotating mechanism is arranged to rotate said rotary shaft, and the workpieces are fitted to said rotary shafts to be rotated together with said rotary shaft.

According to the present invention, the workpieces are rotated together with orbital revolution and rotation of the spindle and otherwise rotated separately from the revolution and rotation of the spindle, whereby the relative positions of workpieces in reference to the spindle vary along with the lapse of time and therefore the direct contact of the fluidized media to the workpieces becomes uniform maximally; thus such irregularity as strong contact or weak contact of the media to certain specific parts of the workpieces are prevented as far as possible and all surfaces of workpieces are polished uniformly and equally.

BRIEF DESCRIPTION OF THE DRAWINGS

The above and other objects, features and advantages of the invention will become more apparent from the following description and claims taken in connection with the accompanying drawings, in which:

DETAILED DESCRIPTION OF THE PREFERRED EMBODIMENT

Figure 2:
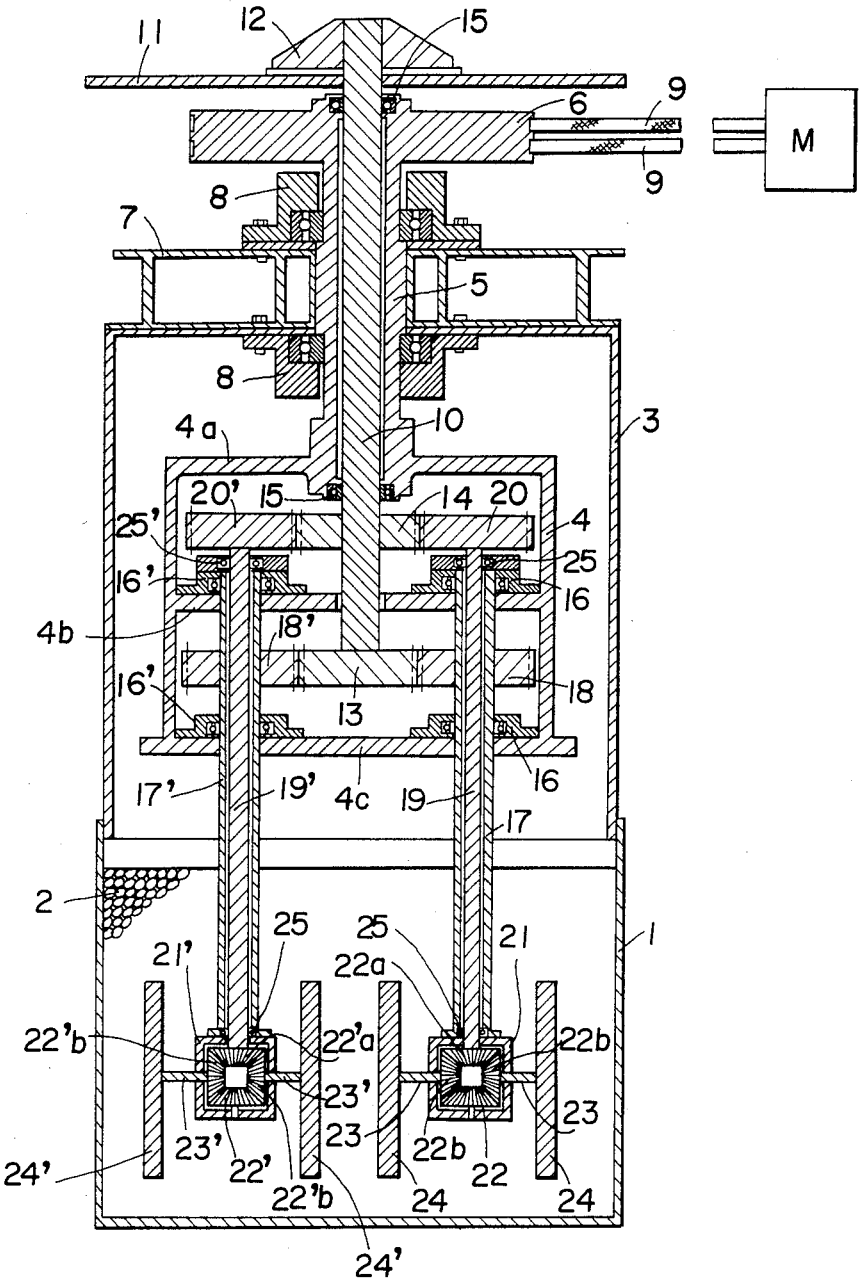
FIG. 2 to FIG. 7 are respectively a rough cross sectional view showing a embodiment of the present invention.

The following describes an embodiment of the present invention, referring to FIG. 2.

In the figure, a polishing bath 1 is filled up with media 2. A cylindrical box 3 which is supported on a structural frame for the machine (not shown) houses a gear box 4. A cylindrical casing 5 is protruded from the center of the upper wall 4*a* of the gear box 4 and a ringshaped drive pulley 6 is provided at the top end of said cylindrical casing 5. Said cylindrical casing 5 is supported to be rotatable by bearings 8 and 8 which are fixed respectively on said cylindrical box 3 and a rack 7 which is fixed to the cylindrical box 3. Said drive pulley 6 is coupled with belts 9 and 9 to a drive source M such as a motor and driven by this drive source M to rotate said cylindrical casing 5 and the gear box 4 together with the drive pulley 6.

A stationary shaft 10 is provided in said cylindrical casing 5. The upper end part of this stationary shaft 10 is passed through the drive pulley 6 and a ceiling plate 11 of the machine and protruded above the ceiling plate 11, and the protruded upper end part is secured by a support member 12 fixed to the ceiling plate 11 and the lower part of the stationary shaft 10 is extended into the gear box 4. A disk-shaped first fixed gear 13 is fixed on the extreme lower end part of the extended lower part of said stationary shaft 10 and a ring-shaped second fixed gear 14 is fixed on the specified position above said first fixed gear 13. Bearings 15 and 15 are provided at upper and lower end parts of the internal wall of said cylindrical casing 5 and accordingly the cylindrical casing 5 can be smoothly rotated around the stationary shaft 10.

Said gear box 4 is provided with a ring-shaped partition 4*b* to separate said first fixed gear 13 from the second fixed gear 14 and two cylindrical spindles 17 and 17' which are supported rotatably by bearings 16, 16 and 16', 16' fixed to said partition 4*b* and the lower wall 4*c*. The lower parts of these spindles 17 and 17' are protruded through the lower wall 4*c* of the gear box. The first planet gears 18 and 18'which are arranged in said gear box and meshed with said first fixed gear 13 are fixed on the upper parts of spindles 17 and 17', thereby, when the gear box 4 is rotated, the spindles 17 and 17' rotate (orbital rotation around the first fixed gear) together with said rotation of the gear box 4. In this case, the first planet gears 18 and 18' rotate around their own axis along the first fixed gear 13 while being kept meshed with said first fixed gear 13 and the spindles 17 and 17' rotate (own rotation) together with own rotation of said first planet gears 18 and 18'.

Rotary shafts 19 and 19' are arranged to be individually rotatable in said cylindrical spindles 17 and 17'. The upper end parts of these rotary shafts 19 and 19' are protruded above through the upper bearings 16 and 16' for the spindles 17 and 17' which are fixed to the partition 4*b*, and the second planet gears 20 and 20' which are meshed with said second fixed gear 14 are fixed to said protruded upper end parts of the rotary shafts 19 and 19'. The lower end parts of said rotary shafts 19 and 19' are arranged rotatably in gear cases 21 and 21' fixed on the lower end parts of the spindles 17 and 17'and fixed on upper bevel gears 22*a* and 22'*a* of a set of bevel gears 22 and 22' (4 pieces) which engage each other. End parts of work fitting jigs 23, 23 and 23', 23' are fixed to lateral bevel gears 22*b*, 22*b* and 22'*b*, 22'*b* which engage with these upper bevel gears 22*a* and 22'*a*, and the other end parts of said work fitting jigs are extended through the side walls of said gear cases 21 and 21'. Workpieces 24, 24 and 24', 24' to be polished can be fitted remountably on these extended other end parts of the jigs. In the figure, the bearings 25, 25 and 25', 25' respectively supports the rotary shafts 19 and 19' to be rotatable.

Accordingly, said rotary shafts 19 and 19' rotate around their own axis (own rotation) at the same time the second planet gears 20 and 20' rotate around their own axis while revolving (orbital revolution) along the second fixed gear 14 as being meshed with the second fixed gear so that workpieces 24, 24 and 24', 24' fitted to said rotary shafts 19 and 19' through bevel gears 22 and 22' and workpiece fitting jigs 23, 23 and 23', 23' may be rotated.

Though not shown, said polishing bath 1 can be vertically moved by the mechanism as shown, for example, in the U.S. Pat. No. 2,899,777 or another appropriate mechanism. Workpieces 24, 24 and 24', 24' are submerged into the media 2 in the polishing bath 1 when the polishing bath 1 shown in FIG. 2 moves up to the upper limit position and lifted up from the media 2 when the polishing bath 1 moves down to the lower limit position, thus permitting the fitting and removing of workpieces 24, 24 and 24', 24'.

The following describes a method for finishing or polishing workpieces by means of said polishing apparatus.

The polishing bath 1 is moved to the lower limit position and filled with raw media 2. In this case, organic media, particularly wooden media such as granular or powder materials of wood leavings, wood chips, corn, nuts and nut shells are excellent as the media and the appropriate quantity of media to be put in the polishing bath 1 is approximately 60 to 90% of the whole capacity of the polishing bath. A liquid, paste, granular or powdery abrasive agent prepared, for example, by mixing fatty substance and abrasive grains is added to the media 2, the polishing bath 1 is moved up to the upper limit position without workpieces fitted to the workpieces fitting jigs 23, 23 and 23', 23', and the drive source M coupled to the pulley 6 is driven to rotate said pulley 6 to rotate (orbital revolution and own rotation) the spindles 17 and 17', etc. By this procedure, the media 2 is fluidized and uniformly mixed with said abrasive agent and said abrasive agent adheres to the surface of media 2. In this case, the amount of abrasive agent to be added is 40 to 80 g for 1 kg of the media in the initial stage of work. It is preferable to add 0.2 to lg of abrasive agent per 1 kg of media at every subsequent polishing operation. A sufficient time for mixing the media and the abrasive agent is generally 3 to 5 minutes.

Figure 1:
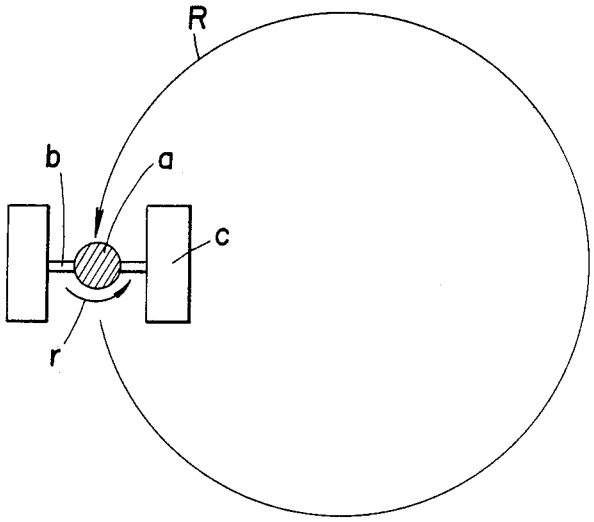
FIG. 1 is a plan view illustrating the rotation state of the workpiece fitted to the conventional spindle.

After the drive source M is stopped and the polishing bath 1 is moved down to the lower limit position, workpieces 24, 24 and 24', 24' are fitted to the workpiece fitting jigs 23, 23 and 23', 23' and the polishing bath 1 is moved again up to the upper limit position (as shown in FIG. 1). When the drive source M is driven and the pulley 6 is rotated under this condition, the cylindrical casing 5 and the gear box 4 rotate together with the rotation of said pulley 6, whereby the spindles 17 and 17' coupled to this gear box 4 revolve (orbital revolution) around the axial line of the cylindrical casing 5 (the axial line of the stationary shaft 10) and are rotated around their own axis by the revolution (orbital revolution) of the first planet gears 18 and 18' mounted on the spindles 17 and 17' while being meshed with the first fixed gear 13 along with the revolution (orbital revolution) of said spindles 17 and 17', and the rotary shafts 19 and 19' installed rotatably in spindles 17 and 17', bevel gears 22 and 22', workpiece fitting jigs 23, 23 and 23', 23' and workpieces 24, 24 and 24', 24', which are fitted to said workpiece fitting jigs 23, 23 and 23', 23', revolve and rotate respectively together with the orbital revolution and own rotation of spindles 17 and 17'. Moreover, along with the above rotational movements, said rotary shafts 19 and 19' are rotated (around their own axis) by own rotation of the second planet gears 20 and 20' fixed to said rotary shafts 19 and 19' which is caused by the revolution (orbital revolution) of said second planet gears 20 and 20' which are kept meshed with the second fixed gear 14; accordingly, workpieces 24, 24 and 24', 24' are rotated around the center axial line of workpiece fitting jigs 23, 23 and 23', 23' (in the direction at right angles to the direction of own rotation of rotary shafts 19 and 19') through upper bevel gears 22*a* and 22'*a* fixed to said rotary shafts 19 and 19', lateral bevel gears 22*b*, 22*b* and 22*b'*, 22*b'* which are meshed with said upper bevel gears 22*a* and 22'*a*, workpiece fitting jigs 23, 23 and 23', 23' which are fixed to these bevel gears in sequence.

In this case, the driving of said drive source M is changed over to the forward or reverse rotation at every lapse of the specified time to change over the above revolution and rotation to the forward or reverse direction at every lapse of the specified time.

Accordingly, workpieces 24, 24 and 24', 24' revolve forwardly or reversely around the center axial line of the cylindrical casing 5 (the center axial line of the fixed shaft 10) and the center axial lines of spindles 17 and 17' and also around the center axial lines of workpiece fitting jigs 23, 23 and 23', 23' which are protruded at right angles to the axial directions of said spindles 17 and 17'; for example, the lower end parts of workpieces 24, 24 and 24', 24' shown in FIG. 2 move to the upper end parts as the workpiece fitting jigs 23, 23 and 23', 23' rotate and the relative positions of workpieces 24, 24 and 24', 24' to spindles 17 and 17' gradually change. Workpieces 24, 24 and 24', 24' are submerged to come in whole contact with stirred fluidized media during their rotation and the surfaces of workpieces are polished by action of abrasive agent applied to media surfaces. As described above, workpieces 24, 24 and 24', 24' rotate around the center axial line of the cylindrical casing 5 and the center axial line of spindles 17 and 17' respectively and furthermore around the axial line of workpiece fitting jigs 23, 23 and 23', 23', and the surfaces of workpieces are uniformly polished in accordance with the variation of the relative positions of workpieces in reference to spindles 17 and 17'.

After completion of the polishing, the driving by the drive source M is stopped, the polishing bath 1 is moved down to the lower limit position, polished workpieces are removed, fresh abrasive agent is added to the medium and the operation described above is repeated.

Though, for the polishing method described above, the rotation rates of the pulley 6 or that of the cylindrical casing 5 and the gear box 4, that is, the number of times of orbital revolutions of spindles 17 and 17' are not always limited, it is preferable to select 50 r.p.m. or over, 50 to 500 r.p.m. as an appropriate range and particularly 100 to 400 r.p.m. Though the own rotation rates of spindles 17 and 17' are not limited, it is preferable to select 50 to 800 r.p.m., 100 to 400 r.p.m. as an appropriate range and particularly 150 to 300 r.p.m. Moreover, the rotation rate of rotary shafts 19 and 19' or that of workpiece fitting jigs 23, 23 and 23', 23' (that is, the rotation rate of workpieces 24, 24 and 24', 24') are also not limited but it is preferable to set 1 r.p.m. or over, 1 to 200 r.p.m. as an appropriate range and particularly 1 to 50 r.p.m. The above-mentioned rotation rates can be preferably selected by appropirately selecting the numbers of teeth of first and second fixed gears 13 and 14, first and second planet gears 18, 18', 20 and 20' and bevel gears 22 and 22'. It is preferable to determine the gear ratio of the first fixed gear 13 to the first planet gear 18 or 18' to be 8:1 to 1:4, 4:1 to 1:3 as a more appropriate value.

By providing a larger number of teeth of the first planet gears 18 and 18' than that of the first fixed gear 13, selecting a higher orbital revolution rate of spindles 17 and 17' than their own rotation rate and setting a larger rotation rate of workpieces 24, 24 and 24', 24' in reference to the center axial line of the cylindrical casing 5 than the rotation rate in reference to the axial line of spindles 17 and 17', all surfaces of workpieces such as spoons and ladles which have a relatively deep concavities, for example, the depth of 5 to 100 mm, particularly 10 to 50 mm can be satisfactorily polished without any part which remains unpolished. In this case, to achieve such effect of action, it is preferable to determine the gear ratio of the first fixed gear 13 to the first planet gear 18 or 18' to be 1:1.2 to 1:4, 1:1.2 to 1:3 as a more appropriate value and particularly, 1:1.5 to 1:2.5.

In the polishing method described above, the driving of the drive source M is changed over to forward and reverse direction at every lapse of the specified time and the above rotational movement is changed over to forward and reverse direction but the polishing can be done by rotation in only one direction. However, the changeover of forward and reverse rotation is desirable from the point of view for uniform polishing and it is preferable to change over the forward and reverse rotation once every 2 to 5 minutes and once or twice during one polishing operation.

Moreover, in the fluidized polishing method described above, an abrasive agent prepared by mixing small quantities of fatty substances and abrasive grains is added to raw media once every cycle of polishing operation and the surfaces of media are covered with the abrasive agent. Accordingly, when the media loses the polishing ability, the abrasive agent can be added to recover the polishing ability of the media without replacement of all of the media and the operation efficiency of the whole apparatus can be simplified. In this case, the covering of media with the abrasive agent can be performed easily and quickly (usually,3 to 5 minutes) since the media are fluidized and uniformly mixed with the abrasive agent along with orbital revolution and own rotation of the spindles and thus the spindles promote the covering effect of media with the abrasive agent. According to such polishing method, favorable polishing is achieved since the media are covered with new abrasive agent every cycle (one polishing operation). Furthermore, the running cost is extremely reduced by this method.

However, the media of which surfaces are covered with fatty substance and abrasive grains can be used and, if the polishing power deteriorates, the whole media can be renewed without employing the above-mentioned method by additionally supplying the abrasive agent as required. Otherwise, the media covered in advance with fatty substance and abrasive grains are used as initial media and subsequently the abrasive agent can be additionary supplied.

The conventionally known media, fatty substances and abrasive grains may be used. For example, animal, vegetable and mineral fats and oils, various types of fatty acids, waxes, metallic soap and synthetic resins are used as fatty substances and alumina, silica, iron oxide, chromium oxide, alundum, WA and calcium carbonate can be used as abrasive grains.

Figure 3:
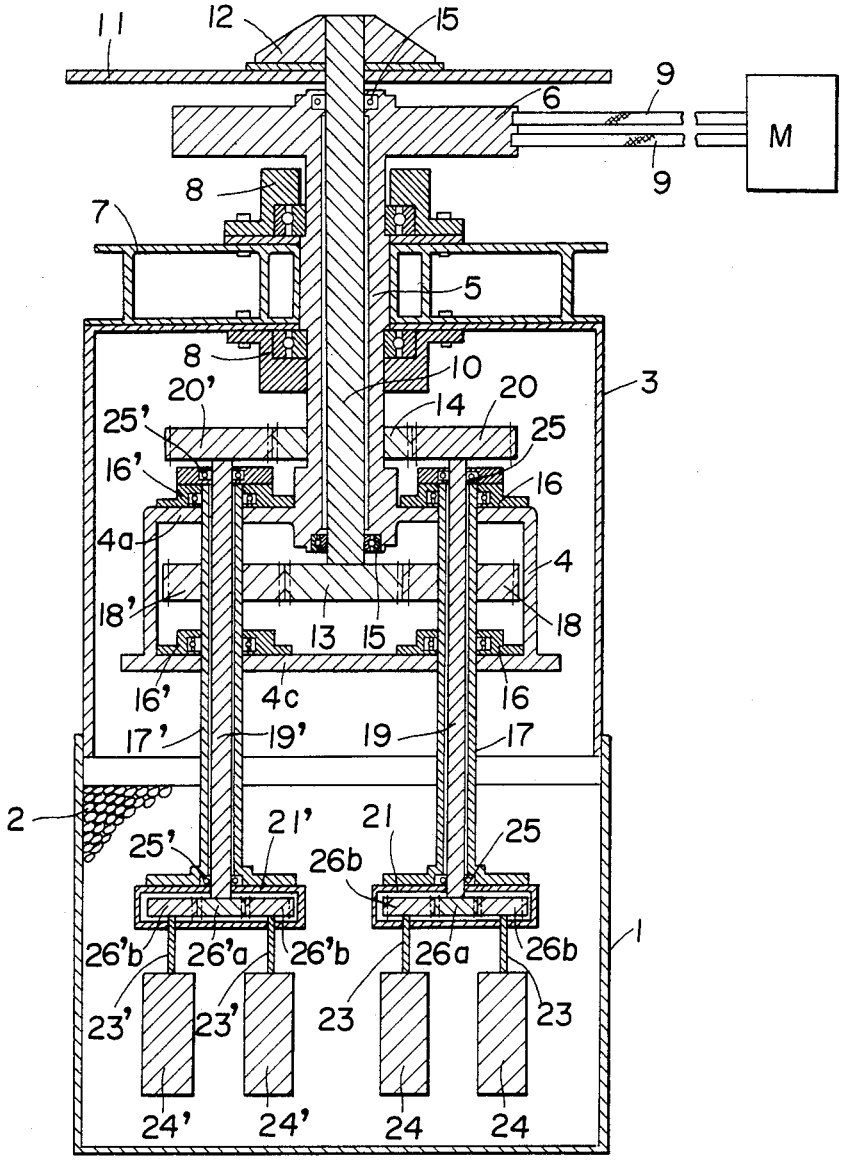

FIG. 3 shows another embodiment of the apparatus in accordance with the present invention. In this embodiment, the first fixed gear 13 and the first planet gears 18 and 18' which mesh with said first fixed gear are arranged in the gear box 4 and the second fixed gear 14 and the second planet gears 20 and 20' which mesh with said second fixed gear are arranged outside the gear box 4. In other words, the partition is not provided in the gear box 4, upper side bearings 16 and 16' which support cylindrical spindles 17 and 17' to be rotatable are fixed on the upper wall 4*a* of the gear box 4, the upper end parts of rotary shafts 19 and 19' which are rotatably arranged in spindles 17 and 17' are protruded above through said upper side bearings 16 and 16', second planet gears 20 and 20' are fixed on said protruded upper end parts of rotary shafts 19 and 19', and the ring-shaped second fixed gear 14 is fixed at the lower part of the cylindrical casing 5 and meshed with second planet gears 20 and 20'. Plain gears 26*a* and 26'*a* housed in the gear cases 21 and 21' are fixed on the lower parts of rotary shafts 19 and 19', these plain gears are meshed with plain gears 26*b*, 26*b* and 26'*b*, 26'*b*, respectively, and workpiece fitting jigs 23, 23 and 23', 23' are fixed in the same direction as the axial direction of said rotary shafts 19 and 19'.

In the embodiment shown in FIG. 3, as in case of the embodiment shown in FIG. 2, workpieces 24, 24 and 24', 24' rotate around the center axial line of cylindrical casing 5 (the center axial line of stationary shaft 10) and the center axial line of spindles 17 and 17', second planet gears 20 and 20' which mesh with the second fixed gear 14 fixed on the cylindrical casing 5 rotate (own rotation) along with the rotation of the cylindrical casing 5, rotary shafts 19 and 19' and plain gears 26*a* and 26*a'* which are fixed on said rotary shafts 19 and 19' rotate together with the rotation of said second planet gears 20 and 20', plain gears 26*b*, 26*b* and 26'*b* which mesh with said plain gears 26*a* and 26*a'* and workpiece fitting jigs 23, 23 and 23', 23' rotate, and workpieces 24, 24 and 24', 24' rotate around the center axial line of workpiece fitting jigs 23, 23 and 23', 23' to gradually change their relative positions in reference to spindles 17 and 17'. Therefore, in the embodiment shown in FIG. 3, workpieces 24, 24 and 24', 24' are also uniformly polished.

Figure 4:
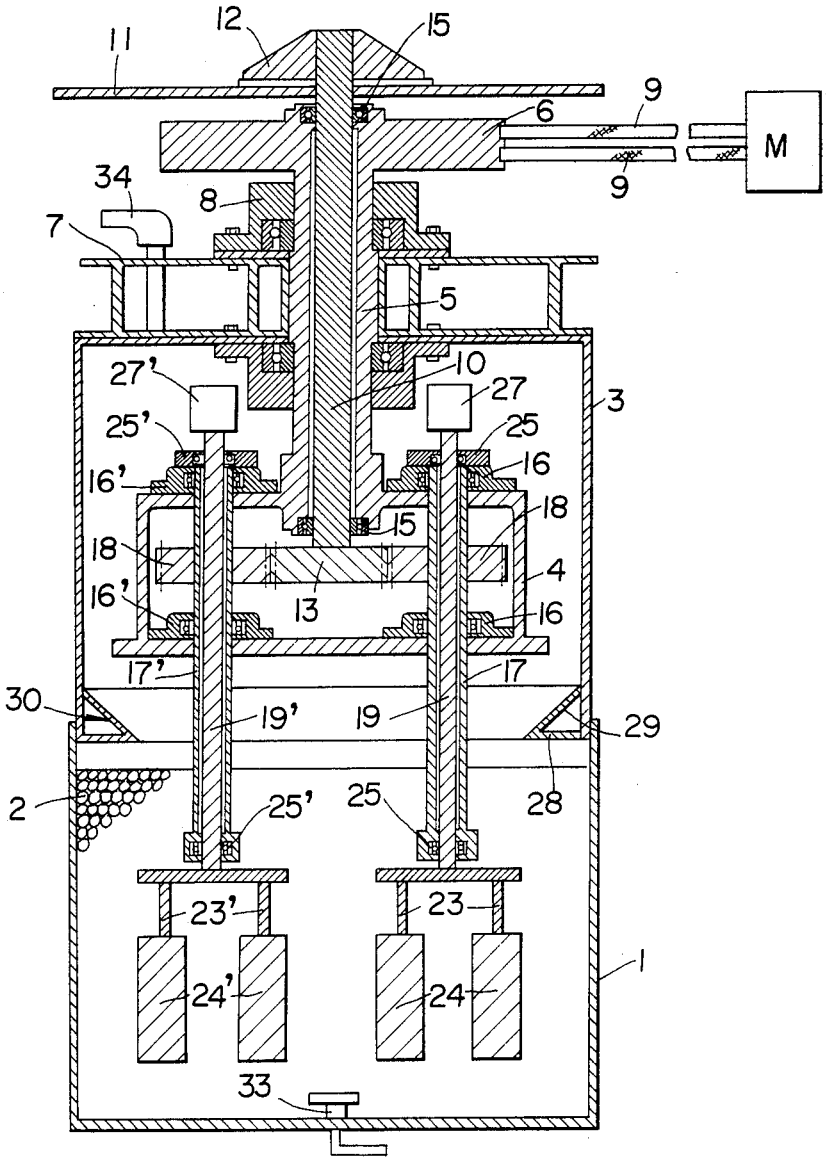

FIG. 4 shows another embodiment in accordance with the present invention. In the apparatus related to this embodiment, the second fixed gear and the second planet gears are not provided, motors 27 and 27' such as geared motors are directly mounted on the protruded upper end parts of rotary shafts 19 and 19' to rotate workpieces 24, 24 and 24', 24' fitted to rotary shafts 19 and 19', thus changing the relative positions of workpieces in reference to spindles 17 and 17'. In this case, the speed reducing devices to be connected to said motors 27 and 27' can be provided. Moreover, in the embodiment shown in FIG. 4, workpiece fitting jigs 23, 23 and 23', 23' are directly fitted to the lower end parts of rotary shafts 25, 19 and 19' without passing through gears and workpieces 24, 24 and 24', 24' are removably fitted to workpieces fitting jigs 23, 23 and 23', 23' In the embodiment shown in FIG. 4, the ring-shaped pressure boosting cover member 30 which has a horizontal part 28 and the sloped part 29 along the circumferential direction and a triangular cross section is provided remountably with bolts on the lower end part of the internal wall of cylindrical box 3. Provision of this cover member 30 prevents media 2 near the internal circumferential wall of the polishing bath 1 from rising beyond the cover member 30 of media which is urged to rise due to stirring and fluidizing effects resulting from the above-mentioned rotational movement. Thus this pressure boosting effect of cover member 30 causes media 2 to closely and positively contact workpieces 24, 24 and 24', 24' so that the workpieces may be more favorably polished. In FIG. 4, air blow pipe 33 and dust collecting pipe 34 are shown. The air blow pipe 33 serves to introduce air as required and the dust collecting pipe 34 serves to discharge pulverized media and polishing wastes.

Other configurations and effects in case of the embodiments shown in FIGS. 3 and 4 are the same as in the embodiment of FIG. 2 and accordingly, the same reference codes as in FIG. 2 are given and the description is omitted.

Figure 5:
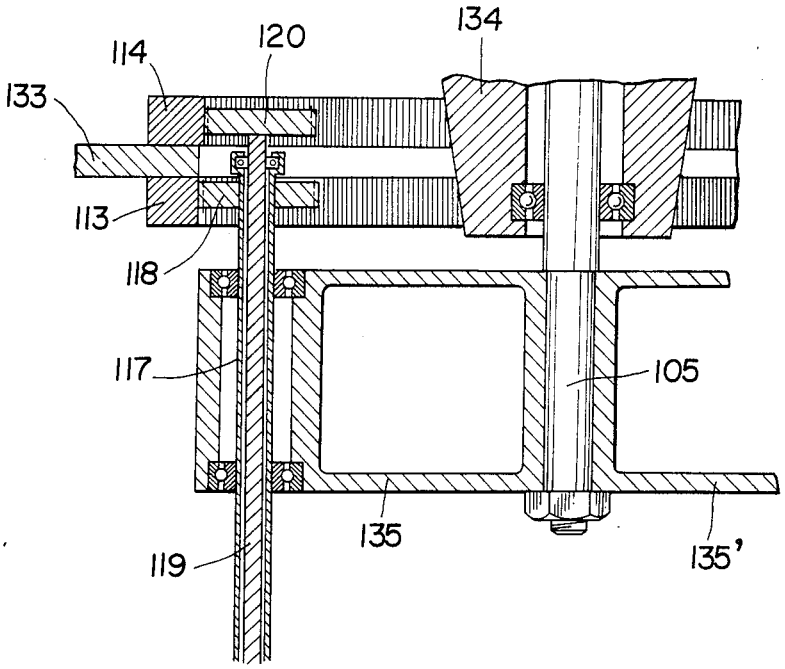

FIG. 5 shows a further another embodiment of the present invention. While the planet gears are externally meshed with the fixed gears in the embodiments shown in FIGS. 2 to 4, the planet gears are internally meshed with the fixed gears in the embodiment shown in FIG. 5. In this embodiment, the ring-shaped first fixed gear 113 provided with teeth on its internal circumference is fixed at the lower side of the ring plate 133 on the equipment frame (not shown) and the ring-shaped gear 114 provided with teeth on its internal circumference is fixed at the upper side of said ring plate 133. The lower part of the cylindrical support member 134 fixed on the equipment frame is extended toward the centers of these first and second fixed gears 113 and 114. The cylindrical casing 105 is supported rotatably in this cylindrical support member 134 and the lower part of said cylindrical casing 105 is protruded below the cylindrical support member 114. The frame members 135 and 135' are fixed to the protruded lower part of this cylindrical casing 105, the cylindrical spindle 117 is supported rotatably at the side end parts of these frame members, and the first planet gear 118 which meshes with said first fixed gear 113 is fixed to the upper end part of said spindle 117. The rotary shaft 119 is arranged rotatably in the cylindrical spindle 117 and the second planet gear 120 which meshes with the second fixed gear 114 fixed to the protruded upper end part of the rotary shaft 119.

Said cylindrical casing 105 is coupled to an appropriate rotation drive source and the workpiece fitting jigs are provided on the rotary shaft 119 through or without through gears as shown in FIGS. 2 to 4, and the workpieces are fitted removably to these workpiece fitting jigs.

Therefore, in case of the apparatus shown as this embodiment, frame members 135 and 135' and spindle 117 rotate together with rotation of the cylindrical casing 105 (orbitally revolve around the center axial line of the cylindrical casing 105) and the first planet gear 118 fixed on the spindle 117 revolves (orbitally) around the first fixed gear 113 to perform its rotation while being kept meshed with the first fixed gear, thus causing the spindle 117 to perform its own rotation. The rotary shaft 119 which is arranged rotatably in this spindle 117 rotates around its own axis by the rotation of the second planet gear 120 fixed on the upper end part of the rotary shaft 119 around the second fixed gear 114 while being kept meshed with said second fixed gear.

Thus, the workpieces fitted to the rotary shaft 119 rotate around the center axial line of the cylindrical casing 105 and the center axial line of the spindle 117 and also rotate together with its own rotation of the rotary shaft 119 to gradually change their relative positions in reference to the spindle 117 so that the workpieces may be favorably polished. Accordingly, in this embodiment, the object of the present invention is effectively achieved.

Figure 6:
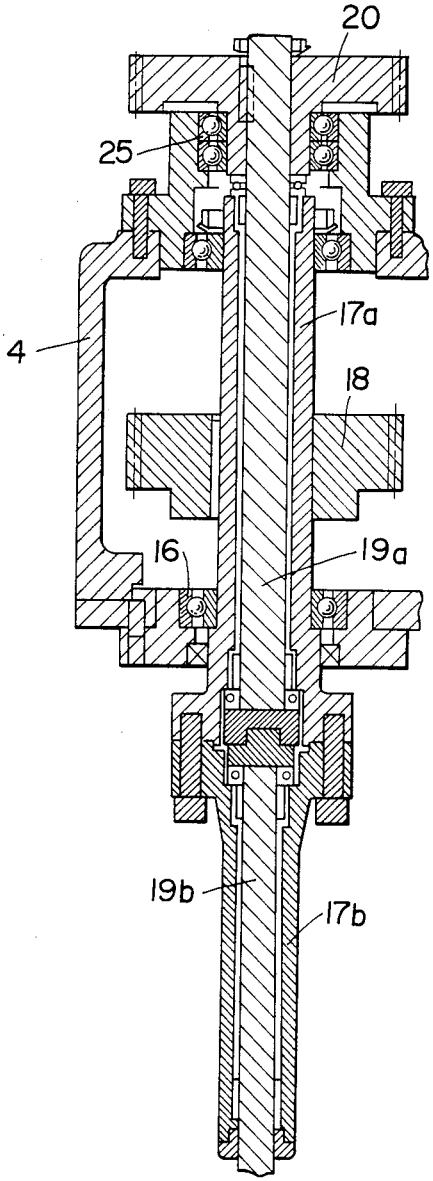
Figure 7:
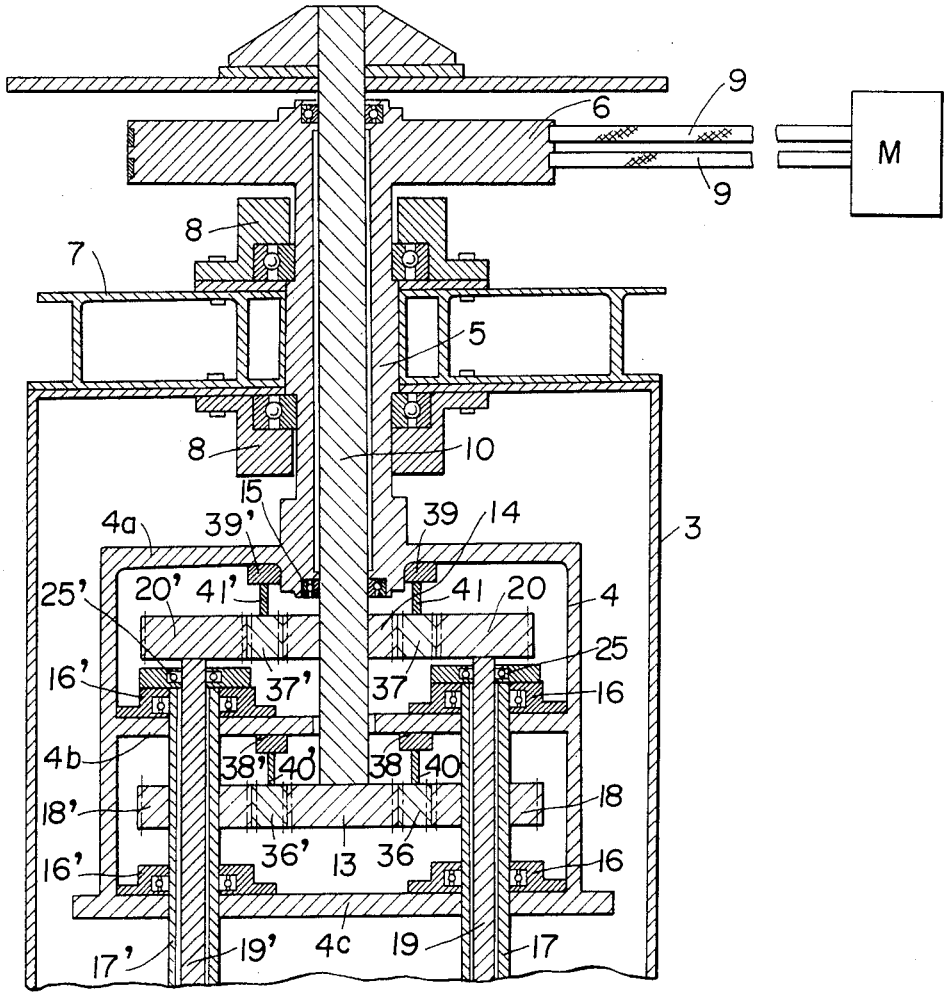

Though two spindles are specified in the embodiments described above, the number of spindles is not limited. In the above embodiments, the spindle rotating shaft is specified as an integrated construction with one shaft but the present invention is not limited to this configuration. For example, as shown in FIG. 6, the upper spindle 17*a* can be coupled to the lower spindle 17*b* and the upper rotary shaft 19*a* to the lower rotary shaft 19*b* as the two-component configuration. In this case, the lower spindle 17*b* and the lower rotary shaft 19*b* can be connected removably. Moreover, as shown in FIG. 7, intermediate gears 36, 36' and 37, 37' can be provided between the fixed gears 13 and 14 and planet gears 18, 18' and 20, 20' (in FIG. 7, bearings 38, 38' and 39, 39' are fixed at the partition 4*b* and the upper wall 4*a* of the gear box 4 and support rotatably the shafts 40, 40' and 41, 41' fitted to said intermediate gears 36, 36' and 37, 37'). Furthermore, other configurations can be diversified in the range which does not deviate from the purpose of the present invention.

As described above, the present invention provides the polishing apparatus which is provided with a fixed gear and at least one planet gear which meshes with the fixed gear to make at least one spindle coupled to said planet gear perform orbital revolution and its own rotation by making the planet gear rotate around its own axis while orbitally revolving said planet gear around the fixed gear, thus rotating the workpieces fitted to said spindle in the polishing bath to be subject to fluidized polishing with the media filled up in the polishing bath, wherein said spindle is formed as a cylinder in which a rotary shaft is arranged rotatably and a rotating mechanism for rotating the rotary shaft is provided to rotate the workpieces at the same time the rotation of said rotary shaft, thus permitting the workpieces to be uniformly polished.

The following examples describe the effect of the fluidized polishing method by means of the apparatus in accordance with the present invention.

EXAMPLE 1

Figure 8A:
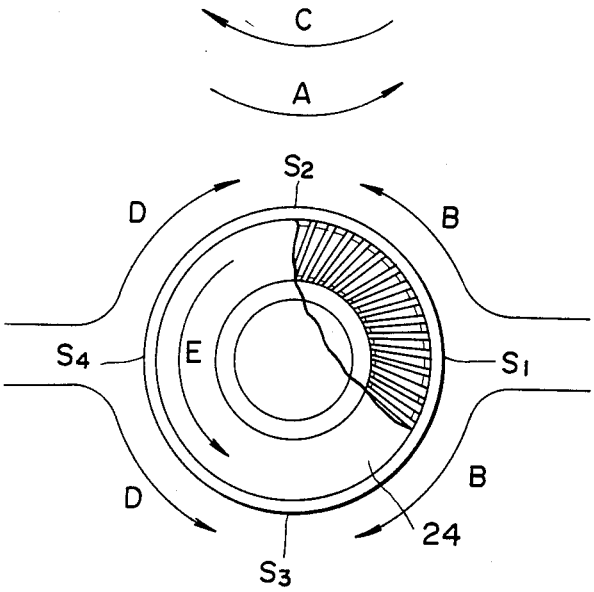
FIG. 8 shows an example of the workpiece which was polished by the apparatus in accordance with the present invention and the conventional polishing apparatus, including (A) the front view and (B) the side view.
Figure 8B:
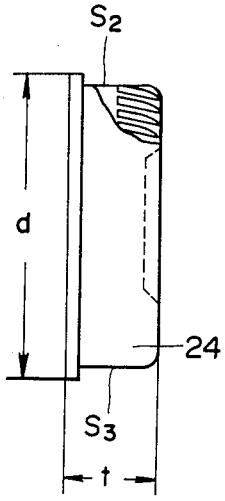

To concretely exhibit the effects of the present invention, the dry, high speed fluidized polishing of a steel shaver case (diameter d: 20 mm, thickness t: 4 mm), which is shown as a workpiece in FIG. 8, was carried out by an apparatus shown in FIG. 2.

The outline of the apparatus and the polishing conditions are as follows:

| | |
|---|---|
| Number of spindles | 2 |
| Gear ratio of the first fixed gear to the first planet gear | 2:1 |
| Rotation rate of the cylindrical shaft (number of orbital rotations of spindles) | 200 rpm |
| Number of own rotations of spindles | 400 rpm |
| Rotation rate of workpiece fitting jig | 5 rpm |

Figure 9:
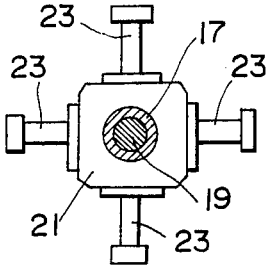
FIG. 9 shows the fitting arrangement of workpieces shown in FIG. 8 on the apparatus of the present invention, including (A) the side view and (B) the cross sectional view along line IX—IX.
Figure 9A:
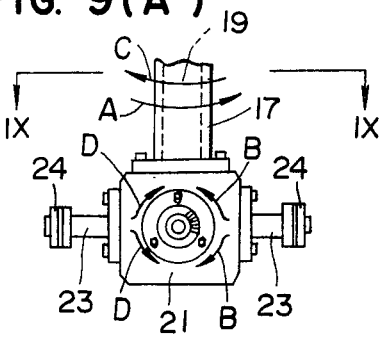

As shown in FIG. 9, four workpiece were fitted to one spindle (eight workpieces in total). In the figure, there are shown spindle 17, rotation shaft 19, gear case 21, workpiece fitting jig 23 and workpiece (shaver case) 24.

The medium for polishing was made up by adding 5 kg of SM compound #70 (manufactured by C. Uyemura Co., Ltd.) to 120 kg of SM cone 12-20 (manufactured by C. Uyemura Co., Ltd.) and covering SM cone particles with SM compound during dry rotation.

Figure 10:
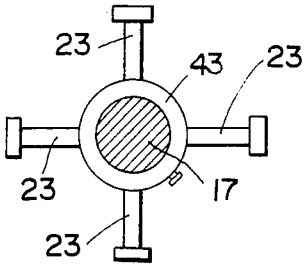
FIG. 10 shows the fitting arrangement of workpieces shown in FIG. 8 on the conventional apparatus, including (A) the side view and (B) the cross sectional view along line X—X.
Figure 10:
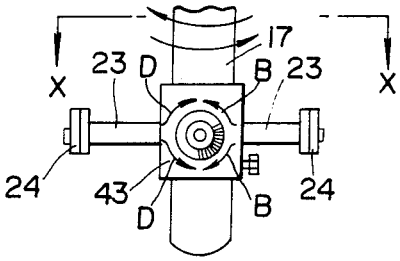

For comparison, workpieces were directly fitted to the spindles with fixing members 43 as shown in FIG. 10 and polished. Accordingly, in this comparison test, the spindles rotate orbitally and around their own axis, and the workpieces fitted to the spindles are also rotated simultaneously with the spindles but the workpieces do not rotate independently from the spindles. Therefore, it is necessary to remove the workpiece from the spindles after polishing the workpieces fitted to the spindle for a settled time, change the fitting positions of workpieces on the spindles, fit again the workpieces to the spindles, and polish again the workpieces. In this comparison test, the polishing positions of workpieces were changed.

The results of polishing finish of workpieces and time spent in polishing by the method described above as shown in Table 1.

TABLE 1

| | Method using the apparatus of the present invention | Example of comparison (Conventional method) |
|---|---|---|
| Polishing time | 2 minutes in clockwise rotation<br>2 minutes in counter-clockwise rotation | 3 minutes in clockwise rotation<br>3 minutes in counter-clockwise rotation |
| Time for changing the positions of workpieces | — | 1.5 minutes |
| Repolishing time | — | 3 minutes in clockwise rotation<br>3 minutes in counter-clockwise rotation |
| Total polishing time | 4 minutes | 13.5 minutes |
| Finish | All surfaces of workpieces were uniformly polished. | The surfaces of workpieces were partly unevenly polished. |

As understood from the results shown in Table 1, the polishing method by means of the apparatus in accordance with the present invention does not require changing of the workpiece position and re-polishing after changing of the workpiece position unlikewise the conventional method since workpieces rotate around:- the spindles and.the polishing time could be greatly reduced (to $\frac{1}{3}$ or less) as compared with the conventional method.

Moreover, all surfaces of workpieces could be uniformly polished despite a substantial reduction of the polishing time. In other words, the polishing method by means of the apparatus in accordance with the present invention features that it is capable of reducing the polishing time and uniformly polishing all surfaces of workpieces.

The conventional method is disadvantageous in that it is difficult to uniformly polish workpieces. This can be explained according to FIG. 8 as follows. If the spindle rotates in the direction of arrowhead A in the figure, the medium flows against workpiece 24 in the direction from one side S1 toward the upper and lower surfaces S2 and S3 in the figure ( the direction of arrowhead B in the figure) and, since the flowing friction of the medium against one side S1 and the upper and lower surfaces S2 and S3 of the workpiece as well as the other side S4 shown in the figure is weak, the polishing force which acts on these workpiece surfaces S1, S2, S3 and S4 will be weak. If the spindle rotates in the direction of arrowhead C, the medium flows against workpiece 24 in the direction from the other side S4 toward the upper and lower surfaces S2 and S3 (the direction of arrowhead D in the figure) and the polishing force which acts on the workpiece surfaces S1, S2, S3 and S4 will also be weak. Therefore, polishing is stopped temporarily and resumed after moving the workpiece to approximately 45°. However, uneven polishing will be unavoidably caused even though the position of the workpiece to be polished is changed.

In case of the polishing method by means of the apparatus in accordance with the present invention, the workpiece 24 rotates in the direction of arrowhead E in the figure to gradually change its relative position to the spindle at every movement and accordingly, the medium contacts uniformly the workpiece surfaces and the workpiece is uniformly polished. Moreover, there is no loss in changing of the position of the workpiece and in the changing time and the time during which the whole workpiece can be uniformly polished is reduced, and hence the workpiece can be efficiently polished.

According to the present invention, the reduction of polishing time and uniform polishing will be positively achieved at the same time.

In the example of polishing by the method using the apparatus in accordance with the present invention, the polishing time was specified to be four minutes in total for clockwise and counterclockwise rotations of the spindle. In case of the above workpiece, no change was observed on the finished surface of workpiece even in polishing by clockwise rotation for four minutes, and the workpiece can be uniformly polished. EXAMPLE 2

Figure 11:
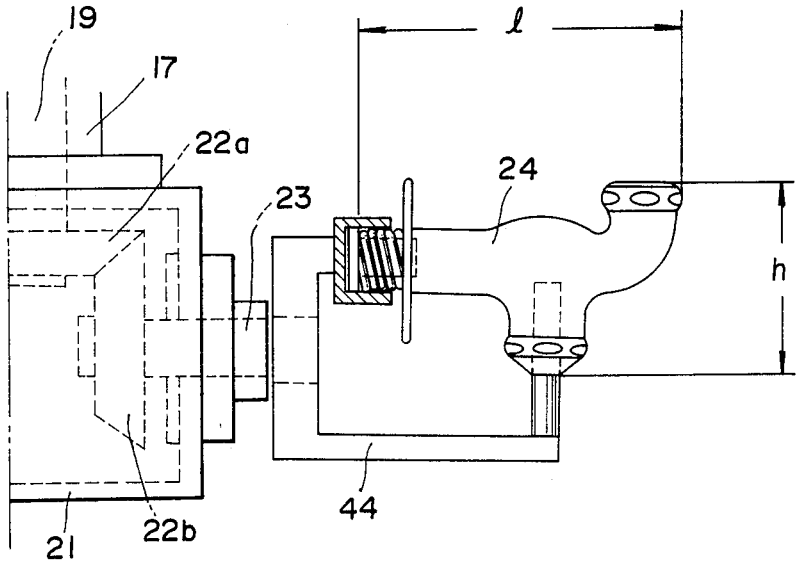
FIG. 11. is a partly omitted side view of other type of workpieces for the apparatus in accordance with the present invention.

A faucet (length l approximately 120 mm and height h 70 mm) as shown in FIG. 11 was used as a workpiece and polished by the same apparatus with the same specification outline as in Example 1 and under the same polishing conditions as in Example 1, excepting that, three workpieces were fitted to one spindle (total number of workpieces: 6). In the figure, the fixing member (workpiece fitting jig) 44 is shown .

Figure 12:
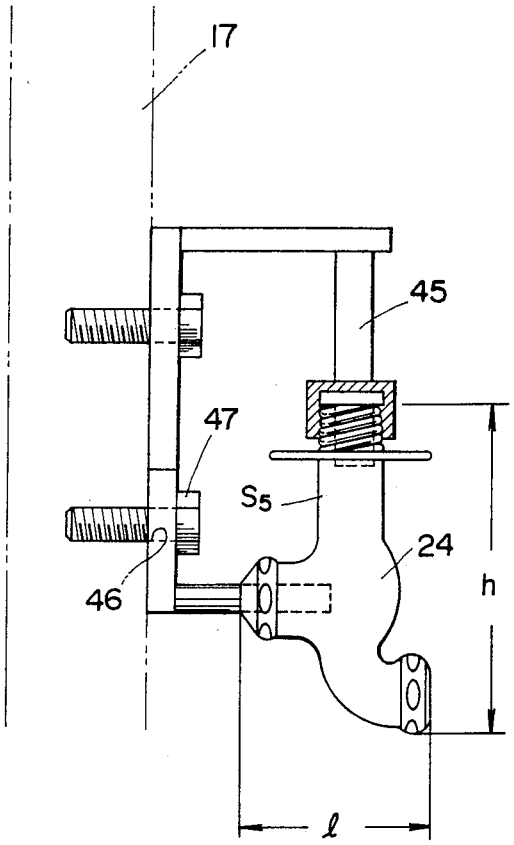
FIG. 12 shows the fitting arrangement of other type of workpieces for the conventional apparatus, including (A) the side view and (B) the front view.
Figure 12B:
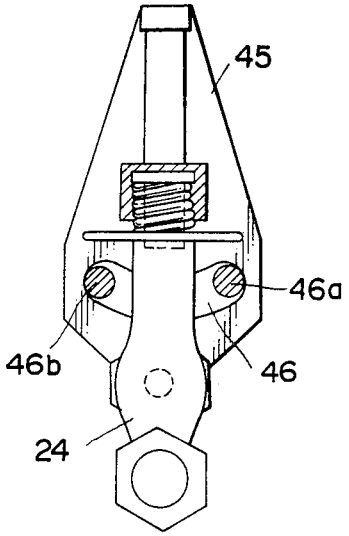

For the purpose of comparison, the workpiece 24 was directly fixed on the spindle 17 with the fixing member 45 as shown in FIG. 12 and the polishing was carried out.

In the polishing method related to this comparison example, the polishing was performed by fixing the fixing member 45 at one end position 46*a* of a circular arc type oval hole 46 with bolt 47, the position of the workpiece was changed by releasing the fixing member 45 and fixing the other end 46*b* of said oval hole 46 with bolt 47 after polishing the workpieces for a settled time, and the polishing was carried out again.

TABLE 2

| | Method using the apparatus of the present invention | Example of comparison (Conventional method) |
|---|---|---|
| Polishing time | 3 minutes in clockwise rotation<br>3 minutes in counter-clockwise rotation | 4 minutes in clock-wise rotation<br>4 minutes in counter-clockwise rotation |
| Time for changing the positions of workpieces | — | 2 minutes |
| Polishing time | — | 4 minutes in clock-wise rotation<br>4 minutes in counter-clockwise rotation |
| Total polish-ing time | 6 minutes | 18 minutes |
| Finish | All surface of work-pieces were uniformly polished. | Incomplete polishing was observed on the workpiece at the spindle side S5. |

It is understood from the results shown in Table 2 that the polishing time can be greatly reduced and all surfaces of the workpiece can be uniformly polished by the polishing method using the apparatus in accordance with the present invention. In other words, according to the polishing method of the present invention, a workpiece rotates independently of the spindle to gradually change its relative position to the spindle at every movement and therefore the polishing medium can uniformly contact and polish the workpiece in a short period of time without changing the position of the workpiece.

On the contrary, in case of the conventional polishing methods, the medium unfavorably contacts the surface S5 of the workpiece at the spindle side and consequently the surface S5 was partly unpolished.

What is claimed is:

1. An apparatus for mechanically finishing workpieces in highly fluidized granular or powdery media coated with an abrasive agent which fills a polishing bath comprising:

a fixed gear;

a planet gear meshed with said fixed gear for rotating along the fixed gear;

a cylindrical spindle fixed to said planet gear for rotating together with the planet gear;

a rotary shaft provided rotatably in said cylindrical spindle for holding a workpiece;

a rotating mechanism for rotating said planet gear along said fixed gear in an orbital path, said planet gear meshed with said fixed gear being rotated on its own axis; and a rotating mechanism for rotating said rotary shaft on its own axis;

whereby said workpiece held by said rotary shaft is rotated around the axis of the fixed gear and the axis of the planet gear through said rotary shaft which is rotated together with the orbital and on-the-axis rotations of said planet gear, and said spindle, and rotated together with the rotation of said roatry shaft on its own axis independently from the rotations of said spindle to vary the relative positions of the workpiece in reference to the spindle along with the lapse of time, thereby the workpiece being uniformly contacted with said media highly fluidized by the rotations of said spindle and workpiece.

2. An apparatus for mechanically fininshing workpieces according to claim 1, wherein a plurality of planet gears are provided for meshing with said fixed gear for rotating along the fixed gear.

3. An apparatus for mechanically fininshing workpieces according to claim 2, wherein a plurality of cylindrical spindles are fixed to respective planet gears for rotating with the planet gears.

4. An apparatus for mechanically finishing workpieces according to claim 3, wherein a plurality of rotary shafts are rotatably positioned in respective cylindrical spindles for individually holding a workpiece.

5. An apparatus in accordance with claim 1, wherein the orbital revolution rate of the spindle is in the range of 50 to 500 rpm, the rotation rate of the spindle is in the range of 50 to 800 rpm and the rotation rate of the rotary shaft is in the range of 1 to 200 rpm.

6. An apparatus in accordance with claim 5, wherein the number of teeth of the planet gear is larger than that of the fixed gear, whereby the orbital revolution rate of the spindle is higher than the rotation rate of the spindle.

7. An apparatus in accordance with claim 1, wherein the number of teeth of the planet gear is larger than that of the fixed gear, whereby the orbital revolution rate of the spindle is higher than the rotation rate of the spindle.

8. An apparatus in accordance with claim 7, wherein the gear ratio of the fixed gear to the planet gear is in the range of 1:1.2 to 1:4.

9. An apparatus in accordance with claim 1, wherein a second planet gear connected to said rotary shaft is meshed with a second fixed gear to perform orbital revolution, along with orbital revolution of said spindle around said second fixed gear while keeping said second planet gear meshed with the second fixed gear, for orbitally revolving said second planet gear and said rotary shaft rotating integrally with the rotation of the second planet gear, whereby said workpieces rotate together with the rotation of the rotary shaft.

10. An apparatus in accordance with claim 1, wherein said rotary shaft is provided with a motor to rotate the rotary shaft, whereby said workpieces rotate together with the rotation of the rotary shaft.

* * * * *